US011365639B2

(12) United States Patent
Krützfeldt et al.

(10) Patent No.: US 11,365,639 B2
(45) Date of Patent: Jun. 21, 2022

(54) SEALING WASHER FOR A ROTOR, AND ROTOR WITH SUCH A WASHER

(71) Applicant: Siemens Energy Global GmbH & Co. KG, Munich (DE)

(72) Inventors: Joachim Krützfeldt, Mülheim an der Ruhr (DE); Peter Schröder, Essen (DE)

(73) Assignee: SIEMENS ENERGY GLOBAL GMBH & CO. KG, Munich (DE)

( * ) Notice: Subject to any disclaimer, the term of this patent is extended or adjusted under 35 U.S.C. 154(b) by 0 days.

(21) Appl. No.: 17/202,762

(22) Filed: Mar. 16, 2021

(65) Prior Publication Data

US 2021/0301671 A1 Sep. 30, 2021

(30) Foreign Application Priority Data

Mar. 24, 2020 (EP) ..... 20165112

(51) Int. Cl.
*F01D 5/30* (2006.01)

(52) U.S. Cl.
CPC ..... *F01D 5/30* (2013.01); *F05D 2220/32* (2013.01); *F05D 2240/30* (2013.01); *F05D 2240/55* (2013.01)

(58) Field of Classification Search
CPC ..... F01D 5/30; F01D 5/3007; F01D 5/3015; F05D 2240/55; F05D 2220/32; F16J 9/12; F16J 9/14; F16J 15/16; F16J 15/3272
See application file for complete search history.

(56) References Cited

U.S. PATENT DOCUMENTS 2,076,164 A * 4/1937 Safford ..... F16J 9/14 277/499
5,253,878 A 10/1993 Miura
2003/0102633 A1 6/2003 Abiko
2014/0308133 A1* 10/2014 Gendraud ..... F01D 11/006 416/193 A (Continued)

FOREIGN PATENT DOCUMENTS

DE 4218323 A1 12/1992
EP 0695894 A1 2/1996
EP 1541908 A1 6/2005

(Continued)

*Primary Examiner* — Woody A Lee, Jr.
*Assistant Examiner* — Elton K Wong
(74) *Attorney, Agent, or Firm* — Wolter Van Dyke Davis, PLLC

(57) ABSTRACT

A sealing washer for use in a rotor of a gas turbine, sealing being brought about on one side of the sealing washer by an approximately radially oriented bearing face and on the other side by way of a supporting face which is oriented in an inclined manner with respect to the rotor axis. The sealing washer is of split configuration and has at least one washer segment with a circumferential washer section. At the dividing point, a pressing section and a triangular section overlap along a dividing face. Here, the dividing face intersects the bearing face and makes sealing both with the pressing section and with the triangular section possible. In order to also make sealing on the supporting face with the pressing section and the triangular section possible, the triangular section is reduced to at most 0.3 times the cross-sectional area of the washer section.

17 Claims, 5 Drawing Sheets

(56) References Cited

U.S. PATENT DOCUMENTS

2017/0037736 A1* 2/2017 Dungs ..... F01D 5/3015

FOREIGN PATENT DOCUMENTS

| | | | |
|---|---|---|---|
| EP | 2119944 | A1 | 11/2009 |
| EP | 2453150 | A1 | 5/2012 |
| GB | 2453231 | A | 4/2009 |
| WO | 9523304 | A1 | 8/1995 |

* cited by examiner

SEALING WASHER FOR A ROTOR, AND ROTOR WITH SUCH A WASHER

CROSS REFERENCE TO RELATED APPLICATIONS

This application claims the benefit of European Application No. EP20165112 filed 24 Mar. 2020, incorporated by reference herein in its entirety.

FIELD OF INVENTION

The invention relates to a two-piece or multiple-piece sealing washer for use in a rotor, in particular in a gas turbine, the ends of the sealing washer overlapping, in order in this way to reduce leakage through the gap which is formed. It is provided here that the sealing washer brings about sealing with respect to further rotor components by means of the centrifugal force. In the case of the present type here, the cross section of the sealing washer is very small in comparison with its diameter.

BACKGROUND OF INVENTION

The prior art has disclosed a sealing washer which has two sealing faces which are arranged at an angle with respect to one another and, in the case of rotation of the rotor, bring about sealing of a gap by means of the centrifugal force. Here, one of the two sealing faces bears against a rotor component on one side of the gap and the other sealing face bears against another rotor component on the other side of the gap.

On account of the multiple-piece configuration of the sealing washer, the ends of the individual sealing washer segments overlap, with the result that no new gap remains open between the sealing washer segments. On account of the relatively small cross section, there is fundamentally a split in half of the sealing washer at a median radius in the case of the overlapping sections, with the result that the two sections which lie above one another have a sufficient rigidity.

It is disadvantageous in the case of the known embodiment, however, that a gap, which, even if it is very small, is not sealed completely, remains in the case of the overlap. In particular, the known embodiment leads to one of the two sections comprising one of the two sealing faces only intermittently, but not exhibiting any sealing on the other sealing face.

SUMMARY OF INVENTION

It is therefore an object of the present invention to further improve the sealing by means of a sealing washer.

The object which is addressed is achieved by way of an embodiment according to the invention in accordance with the teaching of the independent claim. A rotor according to the invention with a corresponding sealing washer is specified in a further independent claim. Advantageous embodiments are the subject matter of the subclaims.

The sealing washer of the generic type serves firstly for use in a rotor for sealing a circumferential gap between various rotor components. The type of rotor here is initially irrelevant, the use being possible, in particular, in the case of a gas turbine. Here, the sealing washer or the rotor defines a rotor axis.

Here, the sealing washer has a bearing face which extends approximately radially and in the circumferential direction.

This is considered to be the case if the angle between the bearing face and a radial direction is at most 15°. Here, the bearing face is delimited by way of an inner bearing edge on the side which points toward the rotor axis and by an outer bearing edge on the side which points radially to the outside.

Furthermore, the sealing washer has a supporting face which is oriented in an inclined manner with respect to the rotor axis. It is provided here that an angle between the supporting face and the rotor axis is at least 15°, but at most 45°. Here, as viewed in the direction of the rotor axis, the supporting face is delimited by a front supporting edge on one side and by a rear supporting edge on an opposite side. Here, the front supporting edge is situated on the side which points toward the bearing face, whereas, in contrast, the rear supporting edge is situated on the sealing washer on the side which points away from the bearing face.

In the circumferential direction, the sealing washer comprises at least one washer section with a substantially constant cross section. Furthermore, the sealing washer has a pressing section and a triangular section. Here, the pressing section adjoins a first section end of the washer section in one piece in the circumferential direction. In contrast, the triangular section is connected in one piece to a washer section at a second section end, it being possible for this to be the same washer section as before or another washer section. A dividing point is therefore produced. It is provided here that the pressing section overlaps the triangular section in the circumferential direction at the at least one dividing point and therefore forms an overlapping region.

Here, a gap remains between the free end of the pressing section and the second section end and, furthermore, between the free end of the triangular section and the first section end. The gaps are required here, in order to permit tolerance compensation and different thermal expansions of the rotor components and the sealing washer. Here, the gaps can be provided structurally with identical dimensions.

Here, the division between the triangular section and the pressing section forms a dividing face. Here, as viewed in the axial direction, the dividing face is delimited firstly by way of a lower dividing face edge and, opposite this, by an upper dividing face edge. Here, the lower dividing face edge is situated generically between the center of the bearing face and the inner bearing edge of the bearing face. Accordingly, both the triangular section and the pressing section have the bearing face in sections. The seal is ensured substantially at this point as long as it is ensured that both the triangular section and the pressing section bear reliably against the adjacent rotor component with the bearing face.

On account of the orientation of the supporting face in an approximation of a cylindrical face, it is ruled out, by way of the customary division in half between the two overlapping sections in the prior art with a separating face which is provided substantially as a section of a cylindrical face, that the section which points toward the rotor axis has a part of the supporting face.

In contrast, it is provided according to the invention that the dividing face is then oriented in an opposed manner with respect to the supporting face, and an unequal distribution between the triangular section and the supporting section is accepted here. It is provided here that the cross-sectional area of the triangular section corresponds merely to up to 0.3 times the cross-sectional area of the washer section. As a consequence, the cross section of the pressing section is at least twice the cross-sectional area of the triangular section. This leads to the possibility of arranging the upper dividing face edge in a region between the center of the supporting face and the rear supporting edge.

The embodiment according to the invention makes it possible for the triangular section and the pressing section as overlapping sections of the sealing washer to likewise be provided at least to some extent with a section of the supporting face, with the result that sealing can be substantially ensured even in this region. In this way, leakage in the region of the overlap can be reduced further in comparison with the embodiment in the prior art.

Sealing by means of the sealing washer is advantageously ensured if the corresponding sealing faces have a sufficient width. (It is generally the case that it is advantageous if the sealing face is configured to be as wide as possible.) To this end, it is advantageous if the bearing face has a bearing height from the lower bearing edge as far as the upper bearing edge, measured in the radial direction, of at least 0.5 times the height of the sealing washer, likewise measured as a dimension in the radial direction. It is likewise advantageous if the supporting face has a supporting width from the rear supporting edge as far as the front supporting edge, measured in the axial direction, of at least 0.5 times the width of the sealing washer, likewise measured in the axial direction.

In order to ensure an advantageous cross section of the triangular section, it is advantageous if the lower dividing face edge is arranged in the vicinity of the inner bearing edge, the spacing from the center of the bearing face being greater than the spacing from the inner bearing edge. In an analogous manner, it is advantageous if the upper dividing face edge is arranged in the vicinity of the rear supporting edge. To this end, the spacing of the upper dividing face edge from the rear supporting edge is to be selected to be smaller than the spacing of the upper dividing face edge from the center of the supporting face.

Furthermore, it is advantageous for the division according to the invention between the triangular section and the pressing section if the dividing face is oriented in an inclined manner which is opposed with respect to the supporting face. To this end, it is advantageous if an angle between the dividing face and the radial direction is between 35° and 55°. It follows obviously from this that the advantageous angle between the dividing face and the rotor axis is likewise between 35° and 55°. It is particularly advantageous, however, if the angle between the dividing face and the radial direction as well as between the dividing face and the rotor axis is between 40° and 50°, and to this extent is arranged diagonally, in an inclined manner which is opposed with respect to the supporting face.

Although it would be possible to use a single-piece sealing washer with only one dividing point, the sealing washer is advantageously formed, however, from at least two washer segments. Here, each of the washer segments has a washer section, the two ends of which, which are opposed in the circumferential direction, are adjoined either by a pressing section or a triangular section. As a consequence, there are two dividing points in the case of two washer segments.

Regardless of the presence of two or more washer segments, it is advantageous, furthermore, if there is a closing washer segment. It is provided here that there is a triangular section on both sides on the closing washer segment. This simplifies final assembly of the closing washer segment in order to form the sealing washer.

In a further embodiment, a closing washer segment is advantageously used which extends over a circumference of at most 20°. This embodiment has the special advantage that merely a small piece of the sealing washer in the form of the closing washer segment is to be removed in order to realize a clearance, for example in order to mount a rotor blade. It is initially irrelevant here whether this is combined with the arrangement of the triangular sections at its ends which lie opposite one another.

The production and mounting of the washer segments are simplified if at least two washer segments, particularly advantageously all of the present washer segments, are formed by identical parts.

Generally speaking, it is to be assumed that the gap to be sealed between the adjacent rotor components is small in comparison with the width of the sealing washer. Accordingly, for sealing purposes, the spacing of the supporting face and therefore the outer bearing edge from the bearing face and therefore from the outer bearing edge is advantageously selected to be not greater than 0.2 times the sealing washer width, as measured in the axial direction. In this way, sealing can take place with optimum closeness to the gap.

In accordance with the proper sealing of a gap and therefore a free spacing between adjacent rotor components, an extent of the supporting face with the front supporting edge as far as the bearing face, that is to say as far as the outer bearing edge, is not required in contrast. To this extent, in order to simplify and avoid a sharp edge, a rounded portion and/or flattened portion can be provided from the outer bearing edge to the front supporting edge.

In order to avoid a sharp-edged groove in a rotor disk for the arrangement of the sealing washer with consideration of an installation space which is as small as possible for the sealing washer and in the process ensuring the necessary stability of the sealing washer, it is advantageous if said sealing washer is rounded in a manner which lies opposite the bearing face. To this extent, as viewed in cross section, the sealing washer has an arcuate section opposite the bearing face adjacently with respect to the supporting face in a manner which points radially inward. This makes an analogous shape in the rotor disk possible and therefore avoids the formation of stress peaks in the circumferential groove which is required to this end (and is continuous in the circumferential direction or is in multiple pieces).

To this end, it is advantageous, furthermore, if a straight section is arranged opposite the supporting face on the side which faces the rotor axis, which straight section connects the arcuate section directly or indirectly to the bearing face or the inner bearing edge.

The realization of a sealing washer according to the invention makes the formation of a novel rotor according to the invention possible. The use of the rotor is initially irrelevant, the solution being suitable, in particular, for use in the case of a gas turbine. Here, the rotor comprises at least one rotor disk, on which a plurality of rotor blades are arranged in a manner which is distributed over the circumference. To this end, the rotor disk has a corresponding number of blade holding grooves which extend through the rotor disk and in which in each case one blade root of the respective rotor blades is arranged. Together with the rotor blades or their blade roots, the rotor disk has an end side, in front of which a plurality of sealing elements are arranged in a manner which is distributed over the circumference. Here, the sealing elements advantageously cover the blade roots and, to this extent, the blade holding grooves.

There is a circumferential gap between the rotor disk with the rotor blades and the sealing elements, which circumferential gap is largely sealed by way of a sealing washer in the case of a generic embodiment of a rotor.

It is then provided according to the invention to use an improved solution of the sealing washer as described above, and therefore to further improve the sealing.

The sealing washer which is used here advantageously has a closing washer segment which makes the mounting and disassembly of rotor blades without complete removal of the entire sealing washer possible. To this extent, the closing washer segment extends over a length which is greater than what corresponds to the width of a blade root. Therefore, in the case of removal of the closing washer segment, the blade root can be installed or removed through the gap which is produced.

Here, the closing washer segment is advantageously not of longer configuration in the circumferential direction than necessary. To this end, the covering angular region of the closing washer segment is selected to be smaller than what corresponds to twice the separation of the blade holding grooves. In the case of 72 blade holding grooves, for example, the closing washer segment extends over at most 10°.

BRIEF DESCRIPTION OF THE DRAWINGS

One exemplary embodiment for a sealing washer according to the invention is outlined in the following figures, in which.

DETAILED DESCRIPTION OF INVENTION

Figure 1:
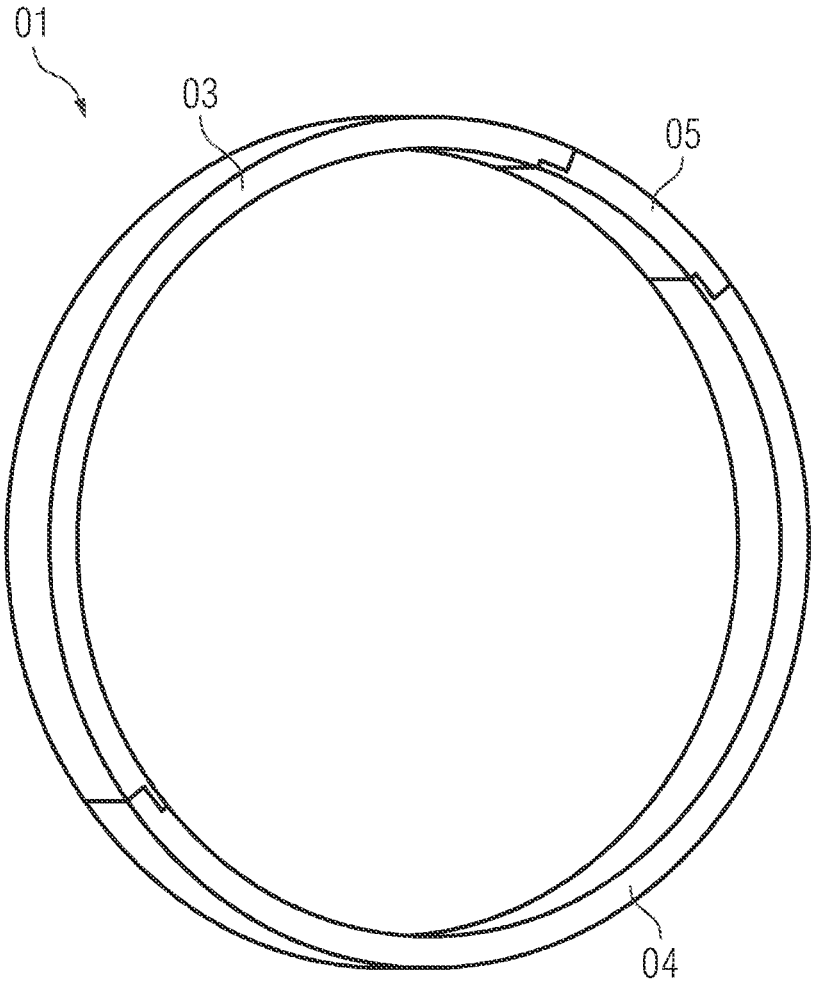
FIG. 1 shows one exemplary embodiment for a sealing washer according to the invention consisting of three washer segments.
Figure 7:
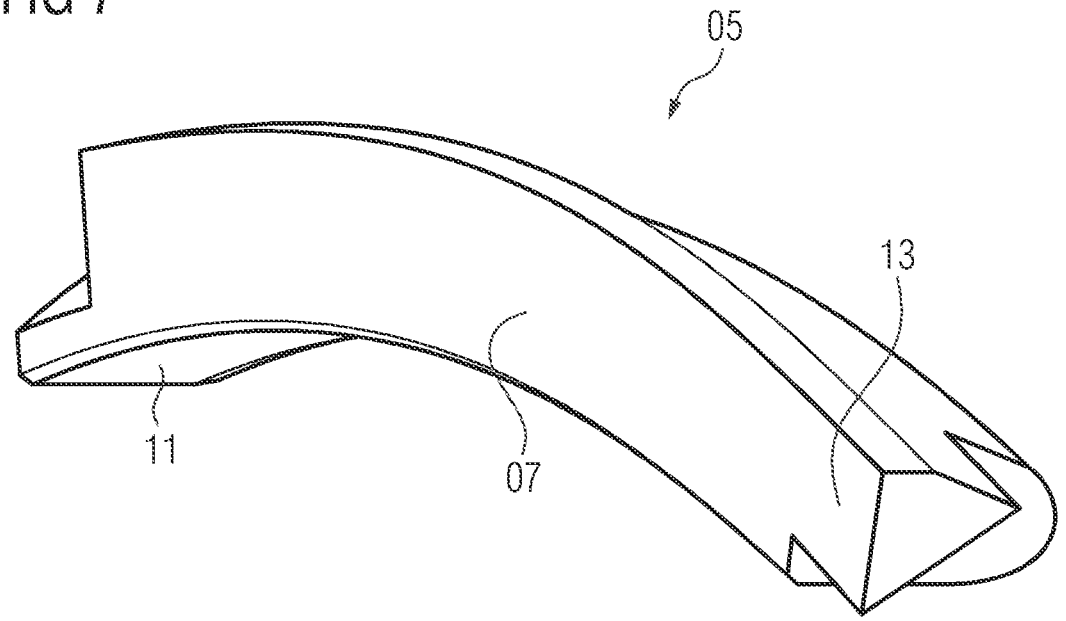
FIG. 7 shows the closing washer segment in a perspective view.

FIG. 1 shows a perspective view of one exemplary embodiment of a sealing washer 01. In said exemplary embodiment, the sealing washer 01 consists of three washer segments 03, 04, 05, two washer segments 03 and 04 being configured as identical parts and extending over an angle of a little more than 170°. Furthermore, there is a closing washer segment 05 which 05 extends over an angular range of approximately 15°; see also FIG. 7.

Figure 2:
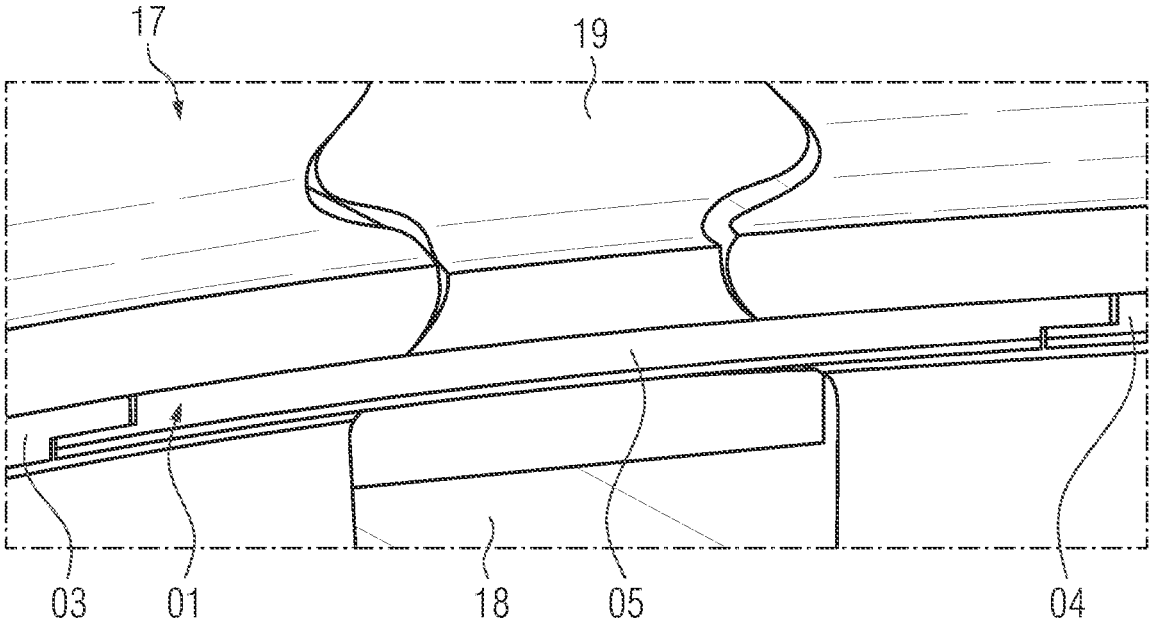
FIG. 2 shows a closing washer segment in the arrangement on a rotor disk.

As can be seen to some extent from FIG. 2, the sealing washer 01 is received in a groove on a rotor disk 17. Here, said rotor disk 17 has a plurality of blade holding grooves 18 in a manner which is distributed over the circumference, in which blade holding grooves 18 rotor blades 19 are in each case fastened by way of a blade root. The closing washer segment 05 is arranged in front of a blade holding groove 18 and therefore in front of the blade root of the rotor blade 19. The overlapping region which is present on both sides with respect to the adjacent washer segments 03, 04 is arranged in a region in front of the rotor disk 17 between the blade holding grooves 18.

Figure 3:
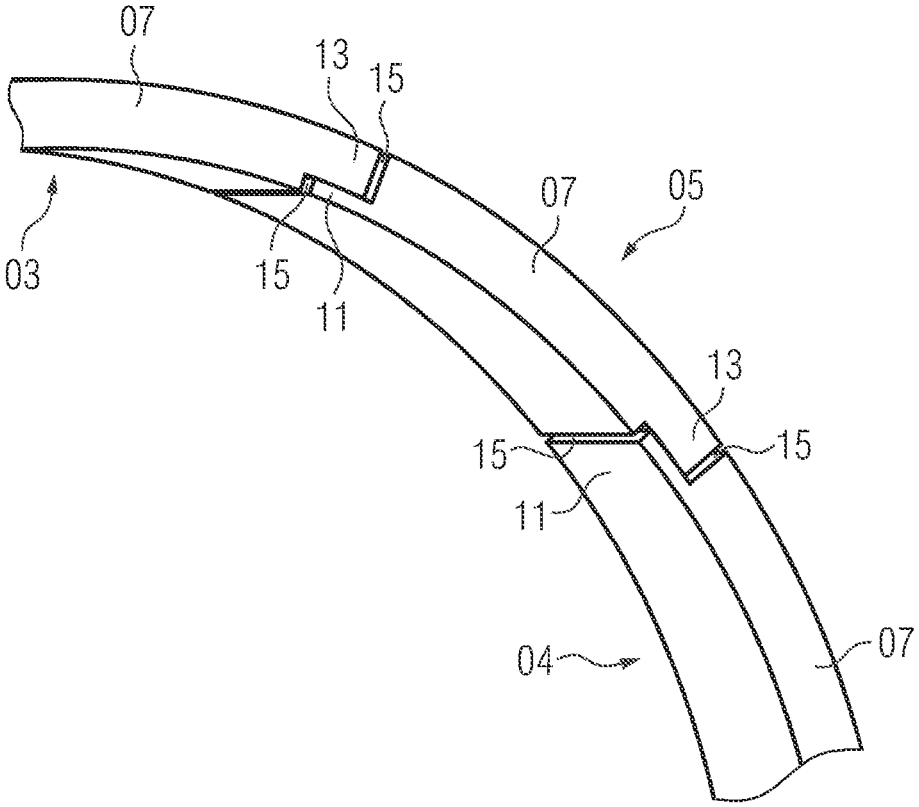
FIG. 3 shows a detailed view of the closing washer segment.

FIG. 3 outlines a detail of the sealing washer from FIG. 1 in the region of the closing washer segment 05. The washer segments 03, 04 and 05 in each case have a washer section 07 which extends in sections in the circumferential direction and has a constant cross section. The respective overlapping region is situated on both sides at the ends of the washer sections 07, either a pressing section 11 or a triangular section 13 being arranged at the respective end. There is in each case a gap 15 in the overlapping region between the adjacent washer segments 03, 04 and 05.

Figure 4:
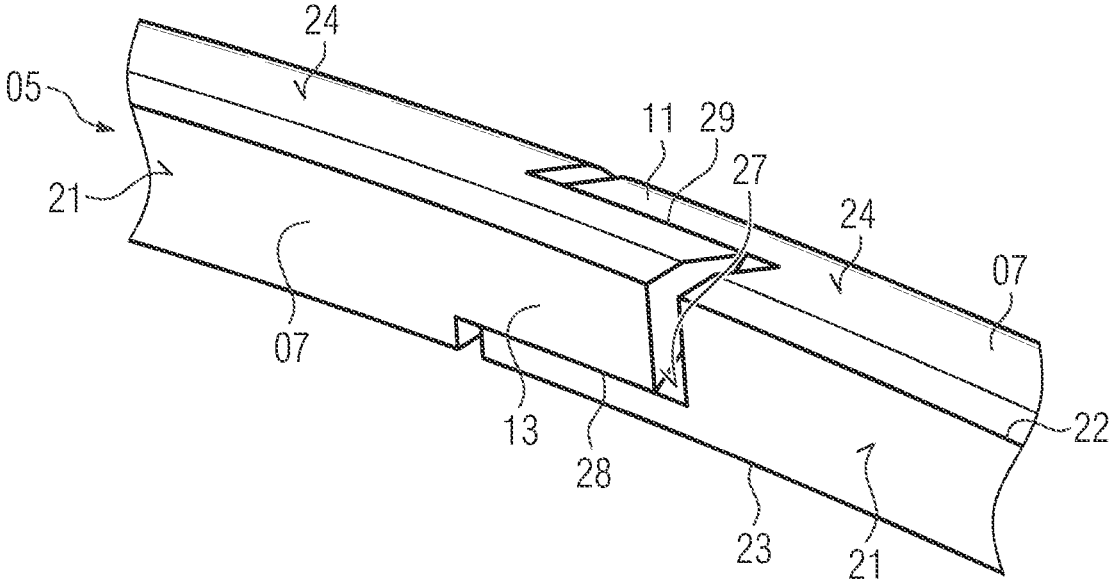
FIG. 4 shows the overlapping region with a view of the bearing face.
Figure 5:
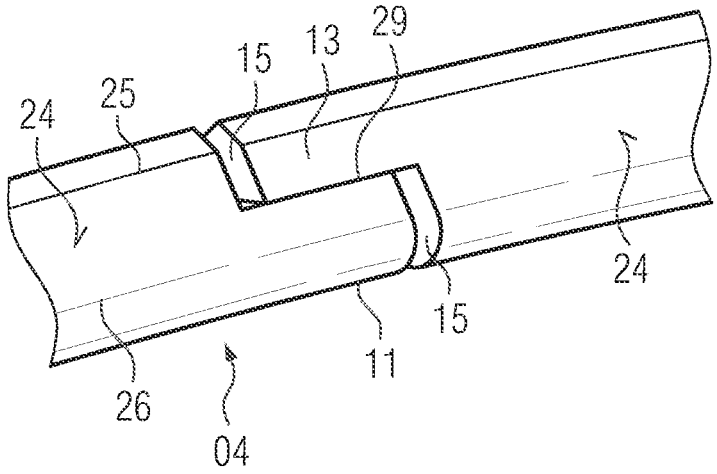
FIG. 5 shows the overlapping region with a view of the supporting face.
Figure 6:
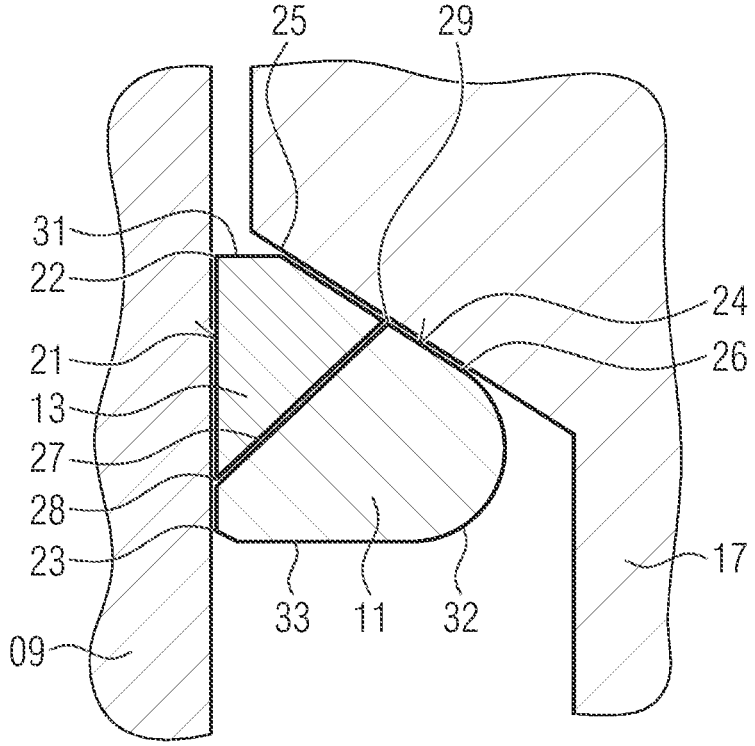
FIG. 6 shows a section through the overlapping region.

In respect of the precise embodiment of the sealing washer 01, reference is made, in particular, to FIGS. 4, 5 and 6. The sealing washer 01 first of all has a bearing face 21 on the side which points away from the rotor disk 17. Said bearing face 21 extends in the radial direction in said exemplary embodiment and is delimited by way of an inner bearing edge 23 on the side which points toward the rotor axis and by way of an outer bearing edge 22 on the side which points radially to the outside. In said exemplary embodiment, sealing elements 09 come to bear against the bearing face 21.

Furthermore, the sealing washer 01 has an inclined supporting face 24 on the side which points radially to the outside and toward the rotor disk 17. Said supporting face 24 is inclined at an angle of approximately 40° with respect to the rotor axis. Here, the supporting face 24 is delimited by a front supporting edge 25 on the side which points radially to the outside, said supporting edge 25 likewise being situated on the sealing washer 01 on the side which points toward the bearing face 21. In a manner which lies opposite, the supporting face 24 is delimited by way of the rear supporting edge 26 which 26 is arranged at that end of the supporting face 24 which points toward the rotor axis and points away from the bearing face 21.

Furthermore, it can be seen from the sectional illustration in FIG. 6 that the supporting face 24 is connected to the bearing face 21 via a flattened portion 31 on the side which points radially outward. In a manner which lies opposite the bearing face 21 and adjacently with respect to the supporting face 24, the sealing washer 01 has an arcuate section 32. Said arcuate section 32 merges into a straight section 33 on that side of the sealing washer 01 which points toward the rotor axis.

In the radial direction, the sealing washer 01 has a sealing washer height, measured from the straight section 33 as far as the flattened portion 31. In the direction of the rotor axis, a sealing washer width is determined from the bearing face 21 as far as the opposite end. As can be seen, a width of the bearing face 21 from the inner bearing edge 23 as far as the outer bearing edge 22 is greater than 0.9 times the sealing washer height. In contrast, a width of the supporting face 24 measured in the direction of the rotor axis from the front supporting edge 25 as far as the rear supporting edge 26 corresponds approximately to 0.6 times the sealing washer width.

Figure 8:
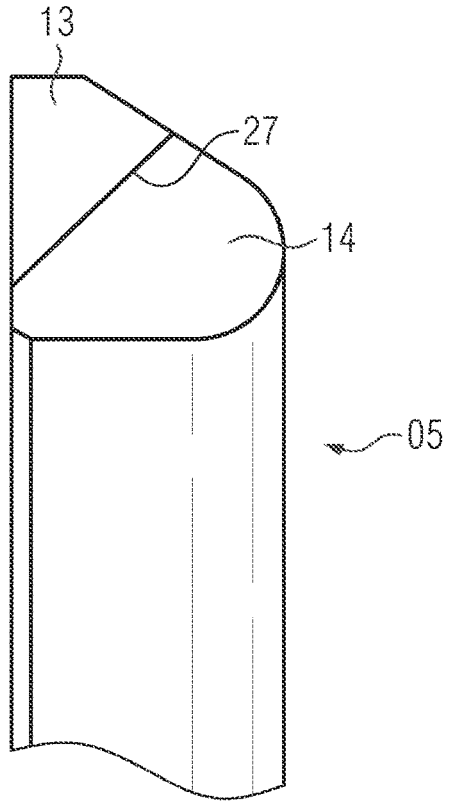
FIG. 8 shows a view of the second section end.
Figure 9:
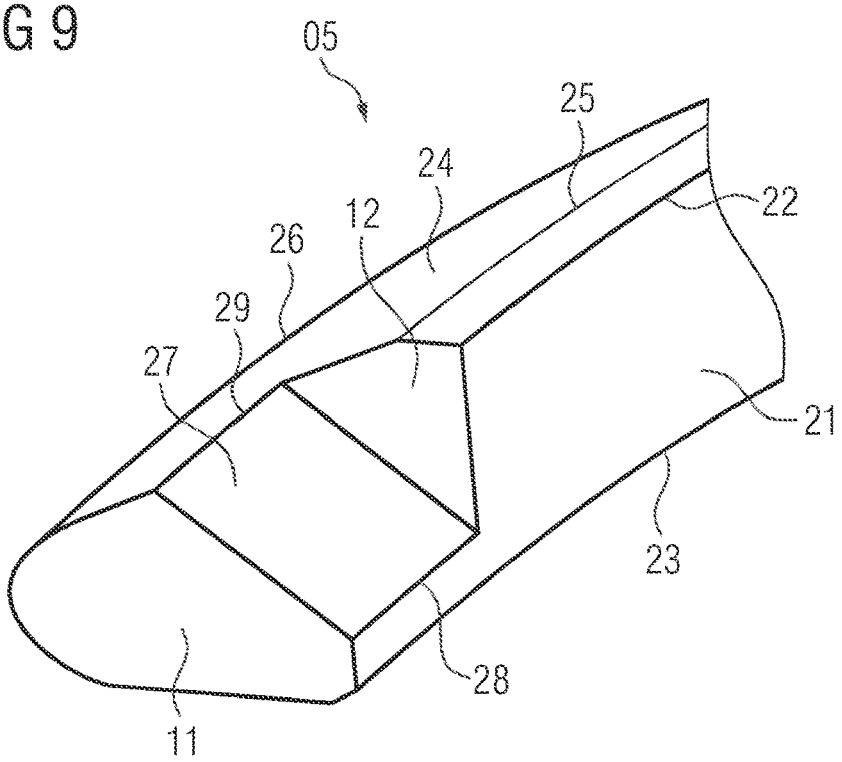
FIG. 9 shows a perspective view of the pressing section.

The overlapping region between two washer segments 03, 04 and 05 is formed in each case by way of a triangular section 13 and a pressing section 11 which bear against one another; see, in particular, FIGS. 4 and 5. Here, the triangular section 13 adjoins a second section end 14 of the corresponding washer section 07 in the circumferential direction; in this regard, see also FIG. 8. In contrast, the pressing section 11 adjoins the adjacent washer section 07 at its first section end 12 in the circumferential direction; in this regard, see FIG. 9. Here, the corresponding gap 15 is formed firstly between the free end of the triangular section 13 and the adjacent first section end 12 and between the free end of the pressing section 11 and the adjacent second section end 14.

Here, the triangular section 13 bears against the pressing section 11 along a dividing face 27. Here, the dividing face 27 extends from a lower dividing face edge 28 as far as an upper dividing face edge 29. As can be seen, in particular, from FIG. 4, the lower dividing face edge 28 intersects in sections the bearing face 21 between the first section end 12 and the second section end 14. It is therefore clear that both the triangular section 13 and the pressing section 11 have the bearing face 21 in sections.

Contrary to the customary embodiments, it is provided according to the invention that the dividing face 27 extends in an inclined manner with respect to the supporting face 24. This leads to the upper dividing face edge 29 intersecting the supporting face 24 in sections. Therefore, both of the triangular section 13 and the pressing section 11 have the supporting face 24 in sections. In said exemplary embodiment, the dividing face 27 is arranged diagonally and has an angle here of 45° with respect to the rotor axis and therefore 45° with respect to the radial direction. In this context, it is to be expressly noted that it is also permissible within the context of the invention if the lower dividing face edge 29 is situated directly at the rear supporting edge 26 and therefore merely a minimum strip of the supporting face 24 remains on the pressing section 11.

The invention claimed is:

1. A sealing washer for use in a rotor, the sealing washer comprising:

a bearing face configured to comprise an angle of at most 15° with respect to a radial direction relative to a rotor axis of rotation and which is delimited by an outer bearing edge and an inner bearing edge, a supporting face configured to comprise an angle with respect to the rotor axis of rotation of at least 15° and at most 45° and which is delimited by a front supporting edge and a rear supporting edge, a washer section which extends in a circumferential direction of the sealing washer, and a pressing section which adjoins a first section end of the washer section in one piece in the circumferential direction and forms a gap with respect to a second section end of the washer section or another washer section, and a triangular section which adjoins the second section end in one piece in the circumferential direction and forms a gap with respect to the first section end and overlaps the pressing section along a dividing face, a lower dividing face edge of the dividing face being arranged between the center of the bearing face and the inner bearing edge, wherein the cross-sectional area of the triangular section corresponds to at most 0.3 times the cross-sectional area of the washer section and an upper dividing face edge of the dividing face is arranged between the center of the supporting face and the rear supporting edge.

2. The sealing washer as claimed in claim 1, comprising:

a sealing washer width in the axial direction along the rotor axis of rotation and a sealing washer height in the radial direction, wherein the bearing face comprises a bearing height along the radial direction of at least 0.5 times the sealing washer height, and/or wherein the supporting face comprises a supporting width along the rotor axis of rotation of at least 0.5 times the sealing washer width.

3. The sealing washer as claimed in claim 1, wherein the spacing of the lower dividing face edge is smaller from the inner bearing edge than from the center of the bearing face; and/or wherein the spacing of the upper dividing face edge is smaller from the rear supporting edge than from the center of the supporting face.

4. The sealing washer as claimed in claim 1, wherein an angle between the dividing face and the radial direction and an angle between the dividing face and the rotor axis of rotation are both between 35° and 55°.

5. The sealing washer as claimed in claim 4, wherein the angle between the dividing face and the radial direction and the angle between the dividing face and the rotor axis of rotation are both between 40° and 50 °.

6. The sealing washer as claimed in claim 1, wherein the sealing washer is formed from at least two washer segments, each comprising: a respective washer section; and on both sides either a respective pressing section or a respective triangular section.

7. The sealing washer as claimed in claim 6, further comprising:

a closing washer segment disposed circumferentially between two washer segments of the at least two washer segments and comprising a respective washer section and on both sides respective triangular sections.

8. The sealing washer as claimed in claim 7, wherein the washer section of the closing washer segment extends circumferentially over at most 20°.

9. The sealing washer as claimed in claim 6, at least two of the washer segments being formed by identical parts.

10. The sealing washer as claimed in claim 1, wherein the spacing of the outer bearing edge from the front supporting edge corresponds to at most 0.2 times the sealing washer width.

11. The sealing washer as claimed in claim 10, wherein the outer bearing edge and the front supporting edge are connected to one another via a rounded portion and/or flattened portion.

12. The sealing washer as claimed in claim 1, wherein the sealing washer comprises, in cross section in a manner which lies opposite the bearing face and is adjacent to the supporting face, an arcuate section.

13. The sealing washer as claimed in claim 12, wherein the sealing washer comprises a straight section between the arcuate section and the bearing face on the side which points toward the rotor axis of rotation.

14. A rotor, comprising:

a rotor disk which, distributed over the circumference, comprises a plurality of blade holding grooves, and a plurality of rotor blades which are fastened in each case by way of a blade holding root in a respective blade holding groove of the plurality of blade holding grooves, and a plurality of sealing elements which are arranged in front of an end side of the rotor disk and an end side of the blade holding roots, and a sealing washer being arranged between the end side of the rotor disk and the sealing elements, wherein the configuration of the sealing washer is as claimed in claim 1.

15. The rotor as claimed in claim 14, wherein the sealing washer comprises at least two washer segments and a closing washer segment therebetween, all comprising a respective washer section, wherein the closing washer segment is wider than a respective blade holding root and extends over an angle which is smaller than twice a separation between circumferentially adjacent blade holding grooves of the plurality of blade holding grooves.

16. The rotor as claimed in claim 14, wherein the rotor is a rotor of a gas turbine.

17. The sealing washer as claimed in claim 1, wherein the rotor is a rotor of a gas turbine.

* * * * *